US005279878A

United States Patent [19]

Föttinger et al.

[11] Patent Number: 5,279,878

[45] Date of Patent: Jan. 18, 1994

[54] FLAME BARRIER MADE OF NONWOVEN FABRIC

[75] Inventors: Walter Föttinger; Jürgen Knoke, both of Weinheim; Peter Grynaeus, Birkenau-Niederliebersbach; Werner Schäfer, Birkenau, all of Fed. Rep. of Germany

[73] Assignee: Carl Freudenberg, Weinheim/Bergstr, Fed. Rep. of Germany

[21] Appl. No.: 649,082

[22] Filed: Feb. 1, 1991

[30] Foreign Application Priority Data

Mar. 23, 1990 [DE] Fed. Rep. of Germany ..... 4009357

[51] Int. Cl.[5] ..... B32B 5/26; B32B 7/12; B32B 9/00; D04H 1/46

[52] U.S. Cl. ..... 428/102; 5/483; 112/402; 428/219; 428/286; 428/290; 428/302; 428/340; 428/920; 428/921

[58] Field of Search ..... 112/402; 428/102, 219, 428/286, 290, 302, 340, 920, 921

[56] References Cited

U.S. PATENT DOCUMENTS 4,331,729 5/1982 Weber .
4,743,495 5/1988 Lilani et al. .
4,748,065 5/1988 Tanikella .
4,865,906 9/1989 Smith .

FOREIGN PATENT DOCUMENTS 0195545 9/1986 European Pat. Off. .
0314244 5/1989 European Pat. Off. .
0323763 7/1989 European Pat. Off. .
0336464 10/1989 European Pat. Off. .
0355193 2/1990 European Pat. Off. .
3713157 1/1988 Fed. Rep. of Germany .

OTHER PUBLICATIONS

"Melliand Textilberichte" (Melliand Textile Reports) (Jun. 1987, pp. 396–401).

*Primary Examiner*—James C. Cannon
*Attorney, Agent, or Firm*—Felfe & Lynch

[57] ABSTRACT

Disclosed is a flame barrier made of a nonwoven fabric of partially graphitized polyacrylonitrile fibers having a weight per unit area of 40 to 100 g/m$^2$ and a maximum thhickness of 1.8 mm. The nonwoven fabric is bonded with highly energetic water jets. The flame barrier can be used as a component of a planar multi-layer structure.

22 Claims, No Drawings

FLAME BARRIER MADE OF NONWOVEN FABRIC

BACKGROUND OF THE INVENTION

The present invention is in a textile flame barrier as a part of a planar multi-layer structure.

Known flame barriers are difficultly flammable fabrics which have numerous uses including: flame-retarding clothing; interior equipment of the passenger areas in air, land and sea crafts; vehicle equipment such as tarpaulins or interior linings of engine compartments; upholstery material; textile interior linings of rooms; and in cushions and mattresses.

The term flame barrier relates to a barrier that prevents a flame from penetrating a visible material into the interior of one of the above objects. "Melliand Textilberichte" (Melliand textile reports) gives a detailed account of these properties (6/1987, 396–401).

The use a light-weight nonwoven fabric made of a difficultly flammable material has been proposed. (Melliand Textilberichte 1987, 396–401). The publication lists numerous organic and inorganic, difficultly flammable fiber materials and sets forth the Limiting-Oxygen-Index thereof (hereinafter - LOI-value). This index reflects the flammability of plastics according to ISO-standard 4589 "Plastics - classification of flammability based on the Oxygen-Index". This standard may also be applied to textiles provided these are made of an organic fiber material. In our atmosphere, effective flame-retarding properties can be expected at LOI-values above approximately 27.

U.S. Pat. No. 4,748,065 discloses a nonwoven fabric for flame protection purposes impregnated with carbon particles which absorb chemical fumes. That fabric is used for fireproof clothing. 90% of the nonwoven material is made of aramide staple fibers. The nonwoven material has a weight per unit area of 35 to 70 g/m$^2$. The fibers are bonded by a double water-jet-treatment, applying a pressure of approximately 1400 kPa once and then jet pressures between 10,000 and 11,000 kPa. The absorbing carbon particles for impregnation, present in an amount of 10 to 50 wt.-%, serve exclusively for the sorption of harmful gases. The carbon particles do not affect the flammability.

This prior art flame-retarding nonwoven fabric consists essentially of still meltable fibers and, hence, is destroyed when directly exposed to flames. That fabric does not pass the flame test according to ISO 8191-1 and -2 and cannot be considered a flame barrier.

THE INVENTION

It is an object of the present invention to avoid such disadvantages and to provide a flame barrier having a combination of the following properties:

a) flame barrier efficiency according to ISO 8191-1 and -2, i.e., which is resistant to smoldering bodies lying thereon;

b) a weight per area unit which does not exceed 100 g/m$^2$ at a maximum thickness of 1.8 mm;

c) a tear strength of at least 70 N/5 cm width in at least one direction;

d) textile drape and wear comfort;

e) which is in conjunction with an adhesive coating easy to laminate;

f) which maintains the flame barrier effect even after fusing to another textile fabric.

The weight per unit area is preferably at least about 40 g/m$^2$ to ensure a uniform fiber density guaranteeing a sufficient flame proofness. A lower weight per unit area leads to increased surface wear and a reduced breaking strength. The strength should be high, particularly when used for upholstery purposes where strength values of 70 N/5cm are required in all area directions.

Weights per unit area of over 100 g/m$^2$ should be avoided for economic reasons and because of the disadvantageously increasing rigidity of the flame barrier. Therefore, the weight per unit area should be 40 to 100 g/m$^2$ and is preferably 60 to 80 g/m$^2$.

The aforesaid objects are accomplished with a textile flame barrier having the characteristic features of the invention.

The fibers used for the flame-retarding nonwoven fabric in accordance with the invention are partially graphitized polyacrylonitrile fibers. Partially graphitized fibers are those fibers only graphitized to such an extent, that their density increases from about 1.18 g/cm$^3$ for polyacrylonitrile to about 1.45 g/cm$^3$. More graphitized fibers have even higher densities (up to 1.79 g/cm$^3$) but these fibers are too brittle to be able to be processed via carding equipment. For a density range of partially graphitized fibers of 1.30 to 1.45 g/cm$^3$ the corresponding LOI values range from 40–65.

As subsequently illustrated in the examples, only fibers of this kind can be used to obtain a weight per unit area in the range of about 40 to 100 g/m$^2$ and about 70 g/m$^2$ and below for the nonwoven fabric to retain its effectiveness as a flame barrier.

The flame barrier can have a thickness of from about 0.5 mm to 1.8 mm.

When using aramid fibers either mixed with cellulose fibers or at 100%, the nonwoven fabric does not retain flame-retarding properties according to ISO standards 8191-1 and -2. These fibers that are also used in flame-retarding nonwoven fabrics are hence not suitable for the present invention which requires a lower weight per unit area.

ISO Standards 8191-1 and 8191-2 are incorporated herein by reference.

It is also important for the present invention that none of the fibers need to be impregnated in order to accomplish the object. While the fibers can be impregnated, the use of toxicologically harmful flame-proof layers and/or physically active adsorptive layers can be completely omitted in the present invention.

The fibers are bonded by the water jet needling technique. The water jets impinge upon the fibers with a pressure of approximately 10,000 kPa. It is also possible to increase the pressure, in several steps or continuously, up to 14,000 kPa.

A so manufactured nonwoven fabric is already sufficient for many fields of applications where flame-proof properties are required, e.g. flame barriers for articles having a surface such as for down cushions to make the cushions resistant to smoldering cigarettes.

For the majority of applications, however, like upholstered furniture under higher mechanical stress, the strength of such a nonwoven fabric is not satisfactory.

The nonwoven fabric can therefore be provided with warpwise as well as weftwise reinforcing threads. It is possible to obtain minimum strengths of 70 N per 5 cm using known sewing techniques when inserting 4 to 24 threads per inch in direction of warp and 4 to 15 threads per cm in direction of weft. Instead of a full-weft interlacing, it is also possible to use a short-weft interlacing.

In that arrangement, the reinforcing threads have a weight proportion of 12 to 60 g/m$^2$ in the nonwoven fabric. Such strengths are lower than those of a fabric of 200 g/m$^2$ known in prior art, however, they are absolutely sufficient for the use contemplated.

The partially graphitized polyacrylonitrile fibers have LOI-values of at least 40. Surprisingly, in most cases, it is not necessary to use materials with these LOI-values for the warp and weft threads. Even threads having an LOI-value below 40 are suitable without impairing the flame-proofness. Suitable materials for the reinforcing threads include, for example, aramids, polyamidimide, aromatic polyimide, highly cross-linked phenol polymers or thermally stabilized polyacrylonitrile. Numerous literature references describing these materials allow the art worker to make a quick selection. The high cost of these special filaments is, however, a serious disadvantage.

It would be expected that the substantially less expensive thermoplastic materials with LOI-values below 27, for example made of polyester or polyamide, should be totally excluded from use in flame-retarding nonwoven fabrics.

However, it has unexpectedly been found that it is possible in many cases of the present invention to use thermoplastic materials with an LOI-value of even below 27 for the reinforcing threads of one interlacing direction without impairing the flame-retarding effect of the nonwoven material or the strength thereof when exposed to fire.

If the material is interlaced in only one direction, fibers with an LOI value below 27 can be used. If the material is interlaced in both directions, at least one of the interlacing fibers should have an LOI value of 27 or greater.

Considering the total strength of the flame barrier in accordance with the invention, it was found to be most expedient to specifically select warp threads from the above mentioned, less expensive thermoplastic materials. The threads do melt when the nonwoven fabric is exposed to flames, however, it was unexpected that the entire fiber entanglement of the nonwoven fabric retains the properties of a flame barrier.

In many cases, the flame barrier can be combined with a decorative fabric/material on the visible side to form a planar multilayered structure. The latter is not required to have flame-retarding properties. For this purpose, it is possible to provide the surface of the flame-retarding nonwoven fabric facing the exterior with a thermoplastic, adhesive mass bonding the decorative material. The adhesive mass can be applied in dots, lines or areawise. The flammability of the adhesive mass can be reduced by specific additives, e.g. red phosphorous with phosphates or bromine salts or $Al(OH)_3$. The disposal of these additives poses problems or either their manufacturing cost is higher because of the sometimes significant toxicity of their reaction products when exposed to fire.

Unexpectedly, however, it has been found that with the flame barrier of the invention, it is possible to use pure thermoplastic adhesive masses on the external side without losing the protective properties of the flame barrier. This also applies in same way to the plurality of bondings between the nonwoven fabric and the protected planar structure underneath. Only in those applications where there is an extreme fire hazard in an easily flammable environment, e.g. under hoods of vehicles, is it not possible to totally omit the flame-retarding additives in the internal adhesive mass alone.

In those applications requiring high isotropic strengths, e.g. upholstered goods, the nonwoven material of the invention can be reinforced in the weight range between 30 to 50 g/m$^2$ by doubling or laminating.

For this purpose, a light-weight, flame-retarding nonwoven material with a thermoplastic or reactive adhesive mass which need not contain flame-retarding additives is coated according to known methods, e.g. paste print coating, powder point coating or spread coating. A second flame-retarding nonwoven fabric, also of a weight per unit area of 30 to 50 g/m$^2$ is laminated with the first nonwoven fabric in a continuous press. The isotropy achieved in the strengths and in the elasticity is higher; also, in warp- and weft thread reinforced nonwoven fabrics, the support of the weft threads in the laminate is improved. The tensile and elongation properties are more uniform and more equal in the laminated structure. At the same time the interlacing threads are bonded more to the fibrous nonwoven structure by the adhesive.

The reactive adhesive mass may be a thermoplastic adhesive and/or a thermosetting system, which, after reaction (thermosetting, crosslinking) is no longer reactive.

The following examples describe the subject-matter in further detail. In the examples, carding is by the standard procedure currently used in the industry. The examples particularly show that when partially graphitized polyacrylonitrile fibers are used, it is possible to obtain a light-weight nonwoven fabric with a high flame resistance by employing the water-jet-needling-technique.

EXAMPLE 1

A nonwoven fabric of 70 g/m$^2$ consisting of partially graphitized polyacrylonitrile staple fibers having an LOI-value of 60 and a titer of 1.7 dtex in an isotropic fiber orientation is bonded in two stages with column-like water jets. In each bonding stage there are 5 nozzle bars the boreholes of which have a diameter of 120 $\mu$m spaced-apart from one another at 0.6 mm. In the first stage, the upper side of the nonwoven fabric is bonded with a jet pressure starting at 25 bar and ending at 140 bar with the pressure increasing from one nozzle bar to the next nozzle bar.

In the second stage, the nonwoven fabric is bonded on its lower side. The pressures are graduated from 80 to 140 bar from nozzle bar to nozzle bar.

In both stages, the nonwoven fabric is transported on a sieve belt with 100 mesh in order to obtain a planar structure with a closed surface.

The nonwoven fabric is then impregnated with a hydrophobing or oleophobing, conventional fluorocarbon resin such that 2% resin remain on the surface area.

25 g/m$^2$ of an adhesive mass of copolyamide with a melting range of 112° to 116° C. are print-bonded on the finished nonwoven semimaterial. The print bonding is on the surface which later faces away from the exterior. The adhesive mass contains a conventional flame-proof agent based on an halogen-free organic phosphorous compound (a halogen-free phosphonate).

The finished material serves as a high-temperature-resistant, non-meltable, heat insulating and sound damping nonwoven fabric useful in sound damping parts in compartments of combustion engines. It is highly deformable, hydrophobic and oleophobic, and due to its permanent deformation and the adhesive coating, it can be easily laminated with foams, nonwoven fabrics, felts, fiber glass and rock wool.

Example 2

A nonwoven material having a weight per unit area of 50 g/m$^2$ consisting of a transverse, water-jet bonded carbon fiber is produced by the same procedure as in Example 1. The nonwoven fabric is reinforced in warp at a distance of 3 mm and in weft at a distance of 25 mm using a magazine-weft-raschel-machine with a nonwoven fabric feed with polyethyleneterephthalate warp yarn (5 g/m$^2$, 50 dtex f 22) and weft yarn on the basis of aramide (11 g/m$^2$ 22 dtex f 100).

The so manufactured, warp- and weft-reinforced nonwoven fabric can be used in bed spreads and cushions The actual upholstery material consists of a top material made of meltable, flame-retarding polyester, a bed ticking made of the same material and a down filling. The construction alone does not resist a burning cigarette; the downs are charred. When, however, the nonwoven fabric in accordance with the invention is sewn to the bed ticking, the flame cannot penetrate and the downs are not damaged.

Example 3

A nonwoven fabric of 70 g/m$^2$ made of 100% partially charred polyacrylonitrile fibers as in Example 1 with a titer of 1.7 dtex is piled with carding and transverse folding and subsequently subjected to water-jet bonding according to the conditions of Example 1. 15 g/m$^2$ of a copolyamid adhesive mass with a melting range of 112° to 116° C. are then print-bonded onto the nonwoven fabric. However, as opposed to Example 1, the adhesive mass does not contain a flame-proofing agent.

This material is fused on an upholstery top material made of flame-retarding polyester fiber and placed on a flammable polyurethane foam of 75 mm thickness. The flame test according to ISO-standard 8191-1 and -2 shows that the foam does not start burning with the above laminate present.

A woven fabric with the same weight per area unit is much thinner by nature than a nonwoven fabric, and does therefore not prevent the flame from penetrating.

Example 4 (Comparative Example) Example 3 is repeated with the two following fiber mixtures:

a) 100 g aramide fibers, 1.7 dtex
b) 35% aramid fiber 1.7 dtex, 65% cellulose fiber with flame-retarding agents, 1.7 dtex.

None of the two nonwoven materials exhibits a flame-retarding effect in the flame test according to ISO standard 8191-1 and -2. The foam material which is underneath and/or behind the nonwoven material burns away.

Example 5

A nonwoven fabric of 35 g/m$^2$ made of 100% partially graphitized polyacrylonitrile as in Example 1, with a titer of 1.7 dtex is piled with carding and transverse folding and then subjected to the water-jet bonding under the conditions of Example 1. 50 g/m$^2$ of a copolyamid adhesive mass with a melting range of 112° C. to 116° C. are print-bonded onto the nonwoven fabric. This adhesive mass, however, as opposed to that of Example 1, does not contain a flame-proofing agent.

This material is laminated with a nonwoven fabric of 50 g/m$^2$ made of 100% partially charred polyacrylonitrile fibers in a continuous press at a fixing temperature of 120° C. as in Example 1. The strength of the laminate is approximately the same in all plane directions; it amounts to 75 Nm. The compound can be equally expanded in all directions.

It will be understood that the specification and examples are illustrative but not limitative of the present invention and that other embodiments within the spirit and scope of the invention will suggest themselves to those skilled in the art.

We claim:

1. A flame barrier comprising a water jet-needled nonwoven fabric of none-meltable partially graphitized polyacrylonitrile fibers having an LOI-value of at least 40, a weight per unit area of 40 to 100 g/m$^2$, a density of about 1.30 to 1.45 g/cm$^3$ and a thickness of from about 0.5 mm to 1.8 mm.

2. The flame barrier of claim 1 wherein the fibers are not impregnated.

3. The flame barrier of claim 1, further comprising reinforcing threads.

4. The flame barrier of claim 3 wherein the reinforcing threads are included in the nonwoven fabric in an amount of 12 to 60 g/m$^2$, which run in direction of warp and weft with 4 to 24 threads per inch embedded in warp direction and 4 to 15 threads per centimeter in weft direction, said nonwoven fabric having a minimum strength of 70 N/5 cm.

5. The flame barrier of claim 3 wherein the reinforcing threads in one direction have an LOI-value below 27.

6. The flame barrier of claim 5 wherein the reinforcing thread is of a thermoplastic material

7. The flame barrier of claim 6 wherein the reinforcing thread is a warp thread.

8. The flame barrier of claim 1 having at least one surface wherein the least one surface is provided with a thermoplastic adhesive mass which contains no flame-retarding additives.

9. The flame barrier of claim 1 wherein the nonwoven fabric has a weight per unit area of 30 to 50 g/m$^2$ and is doubled or laminated with a second nonwoven fabric having a weight of 30 to 50 g/m$^2$.

10. The flame barrier of claim 9 wherein there is an adhesive mass between the nonwoven fabrics.

11. The flame barrier of claim 1 wherein said fabric is bonded by means of high-energetic water jets.

12. The flame barrier of claim 1 wherein the weight per unit area is 60 to 80 g/m$^2$.

13. A protected structure comprising an article having a surface and a flame barrier on said surface, said flame barrier comprising a water jet-needled nonwoven fabric of non-meltable partially graphitized polyacrylonitrile fibers having an LOI-value of at least 40, a weight per unit area of 40 to 100 g/m$^2$, a density of about 1.30 to 1.45 g/cm$^3$ and a thickness of from about 0.5 mm to 1.8 mm.

14. The protected structure of claim 13 wherein the fibers of the flame barrier are not impregnated.

15. The protected structure of claim 13 wherein the flame barrier further comprises reinforcing threads.

16. The protected structure of claim 13 wherein the reinforcing threads are included in the nonwoven fabric in an amount of 12 to 60 g/m$^2$, which reinforcing threads run in direction of warp and weft with 4 to 24 threads per inch embedded in warp direction and 4 to 15 threads per centimeter in weft direction, said nonwoven fabric having a minimum strength of 70 N/5 cm.

17. The protected structure of claim 13 wherein the reinforcing threads in one direction have an LOI-value below 27.

18. The protected structure of claim 13 wherein said nonwoven fabric has at least one surface wherein said least one surface is provided with a thermoplastic adhesive mass which contains no flame-retarding additives.

19. The protected structure of claim 13 wherein the flame barrier is doubled or laminated with a second nonwoven fabric with an adhesive mass between the nonwoven fabrics.

20. The protected structure of claim 13 wherein said fabric is bonded with high-energetic water jets.

21. The protected structure of claim 17 wherein the reinforcing thread is of a thermoplastic material.

22. The protected structure of claim 13 wherein the weight per unit area is 60 to 80 g/m$^2$.

* * * * *